US005944191A

United States Patent [19]

Ray et al.

[11] Patent Number: 5,944,191

[45] Date of Patent: Aug. 31, 1999

[54] PEELABLE ENTRY-RESISTANT PACKAGE

[75] Inventors: Thomas O. Ray, Richmond; Gene C. Matthews, Powhaten, both of Va.

[73] Assignees: Fuisz Technologies Ltd., Chantilly; Reynolds Metals Company, Richmond, both of Va.

[21] Appl. No.: 09/006,751

[22] Filed: Jan. 14, 1998

[51] Int. Cl.[6] ..... B65D 83/04

[52] U.S. Cl. ..... 206/532; 206/538

[58] Field of Search ..... 206/528, 531, 206/532, 534.2, 536, 538

[56] References Cited

U.S. PATENT DOCUMENTS

| | | | |
|---|---|---|---|
| 3,246,746 | 4/1966 | Holley . | |
| 3,659,706 | 5/1972 | Serrell . | |
| 3,737,029 | 6/1973 | Serrell et al. . | |
| 3,835,995 | 9/1974 | Haines | 206/532 X |
| 3,924,747 | 12/1975 | Gerner . | |
| 4,011,949 | 3/1977 | Braber et al. | 206/532 |
| 4,838,425 | 6/1989 | O'Brien et al. . | |
| 4,911,304 | 3/1990 | Bunin . | |
| 5,172,812 | 12/1992 | Wharton et al. . | |
| 5,325,968 | 7/1994 | Sowden | 206/538 X |
| 5,758,774 | 6/1998 | Leblong | 206/532 X |

*Primary Examiner*—Jacob K. Ackun
*Attorney, Agent, or Firm*—Richard D. Schmidt

[57] ABSTRACT

A child resistant tablet package accommodates low density pharmaceutical tablets. The package includes a blister tray having a plurality of blister depressions which accommodate the low density porous pharmaceutical tablets. The blister tray further includes a frangible tray extent spaced adjacent to each blister depression. The frangible tray extent may be manually punctured through the surface of the blister tray. A planar lid is removably sealed over the blister tray and encloses the tablets within the blister depressions. The blister lid includes frangible cover extents overlying each of the frangible tray extents. The cover extents and the tray extents may be frangibly displaced so as to establish a graspable peel tab to facilitate peelable removal of portions of the cover from the overlying disposition with respect to the blister depressions so as to expose the tablets for dispensing.

19 Claims, 6 Drawing Sheets

PEELABLE ENTRY-RESISTANT PACKAGE

FIELD OF THE INVENTION

The present invention relates generally to packages for containing low density porous tablets. More particularly, the present invention relates to child-resistant blister packaging for containing and dispensing low density porous tablets where the blister packaging inhibits undesirable entry and yet permits the dispensing of the fragile tablets without damage thereto.

BACKGROUND OF THE INVENTION

It is well known to use blister packaging to contain items such as pharmaceutical tablets or capsules. Conventional blister packages include a blister tray which is typically a thermo-formed plastic sheet having a plurality of blister depressions or cells formed therein. A lid stock is placed in overlying disposition over the blister trays to enclose the tablets contained within the individual blister depressions. The lid stock is typically sealed to the blister tray providing environmental protection thereto. The blister package provides some degree of protection to the tablets during shipping and storage and also provides for the convenient dispensing of the individual tablets from the package.

Removal of tablets from the blister package may be accomplished in one of two conventional techniques. The first technique is to provide lid stock which is supported over the blister tray in a manner where the lid stock can be easily removed from the blister tray providing ready access to the tablets contained in the blister depressions. In such embodiments the lid stock is adhesively sealed to the blister tray by a non-aggressive adhesive so that the lid stock, or a portion of the lid stock (lid) may be easily peeled from the blister tray so as to permit removal of the tablets. In such situations a non-sealed peel tab may be established adjacent one edge of the blister tray to facilitate manual peeling of the lid stock. Examples of blister packages having removable lids disposed adhesively over a blister tray are shown in U.S. Pat. Nos. 3,246,746 to Holley; 3,659,706 to Serrell; and 3,737,029 to Serrell, et al.

The second technique for permitting the removal of tablets from a blister package is to provide a readily rupturable lid stock over the blister tray. Such lid stock is formed of a laminated material which may be easily ruptured by manually deforming the blister depression and forcing the tablet through the lid stock. In such embodiments the tablet is removed from the blister package by manually pushing the blister depression and forcing the tablet held in the depression through the rupturable lid stock. The lid stock may be sufficiently thin and flexible so as to permit non-destructive passage of a conventional tablet or capsule therethrough. Examples of such push-through blister packages are shown in U.S. Pat. No. 3,924,747 to Gerner and U.S. Pat. No. 4,911,304 to Bunin.

Various other blister packages having rupturable and/or peelably removable lids are shown in U.S. Pat. Nos. 4,838,425 to O'Brien, et al. and 5,172,812 to Wharton, et al.

While the above-described techniques for storing and dispensing pharmaceutical tablets using lid stock and trays serve adequately for their intended purposes, there are certain inherent drawbacks in such designs. In both the peelable design and in the push-through design, the removal of the tablet from the package is easily accomplished. In the peelable cover design, the adhesive which holds the cover to the blister tray is relatively non-aggressive and a tab is provided which facilitates easy peelable removal of the cover from the tray. In the push-through design, the lid stock is formed of relatively thin and flexible material so as to permit the easy puncturing of the cover by the tablet without destroying the tablet.

As may be appreciated, neither of these basic designs is child entry-resistant. Thus, a child would be capable of readily dispensing the tablet from the package. Techniques have been developed to make such blister packages sufficiently child entry-resistant. However, certain of these techniques have been found to be unacceptable in certain situations. Many child resistant packages have been designed which require significant force and manual dexterity so as to render the table inaccessible to a child. Such devices however have resulted in rendering the package difficult to open even by adults. Also, specifically with respect to push-through type packages where the tablet must be forced through the lid stock, the push-through action may result in destruction of the tablet especially in situations where low density porous tablets are employed. This destruction renders the tablet useless.

It is therefore desirable to provide an improved blister package design which accommodates tablets, including low density pharmaceutical tablets where the blister package is adequately child entry-resistant and yet is simple and easy to open by an adult.

SUMMARY OF THE INVENTION

It is an object of the present invention to provide a tablet package for protecting and dispensing tablets.

It is a further object of the present invention to provide a child entry-resistant blister packaging for containing and dispensing tablets.

It is a still further object of the present invention to provide child entry-resistant blister packaging for containing and dispensing tablets which is adequately child entry-resistant yet is simple and easy to use by an adult.

In the efficient attainment of these and other objects, the present invention provides an entry-resistant tablet package for accommodating tablets. The package includes a blister tray having a first surface including a plurality of spaced apart open ended tablet accommodating blister depressions formed therein. A planar lid, or lid stock is removably sealed over the first surface having portions overlying disposed over the open ends of the blister depressions. The lid stock further includes a manually puncturable cover extent spaced adjacent to each of the plural tablet accommodating blister depressions. The puncturable cover extent is frangibly displaceable from the plane of the lid stock to establish graspable peel tab to facilitate peelable removal of portions of the cover from the overlying disposition with respect to the blister depressions so as to expose the tablets for dispensing.

As more particularly described by way of the preferred embodiments herein, the package assembly permits access to the tablets contained therein yet is child entry-resistant in that a given degree of puncturable force is necessary to establish a peel-tab. However, such force is applied away from the tablet so as to protect fragile porous tablets.

In one embodiment of the present invention a blister tray includes a perforated portion having a slit thereacross the plastic tray adjacent the blister depression. The perforation and the slit allow the lid stock and the perforated portion to be punctured through thereat so as to establish the peel tab.

In a second embodiment, a portion of the cover is non-adhesively supported to the blister tray at a location spaced adjacent the blister depression. The blister tray can be depressed over the non-adhered portion of the cover so as to puncture the cover establishing the peel tab.

DETAILED DESCRIPTION OF THE PREFERRED EMBODIMENT

Figure 1:
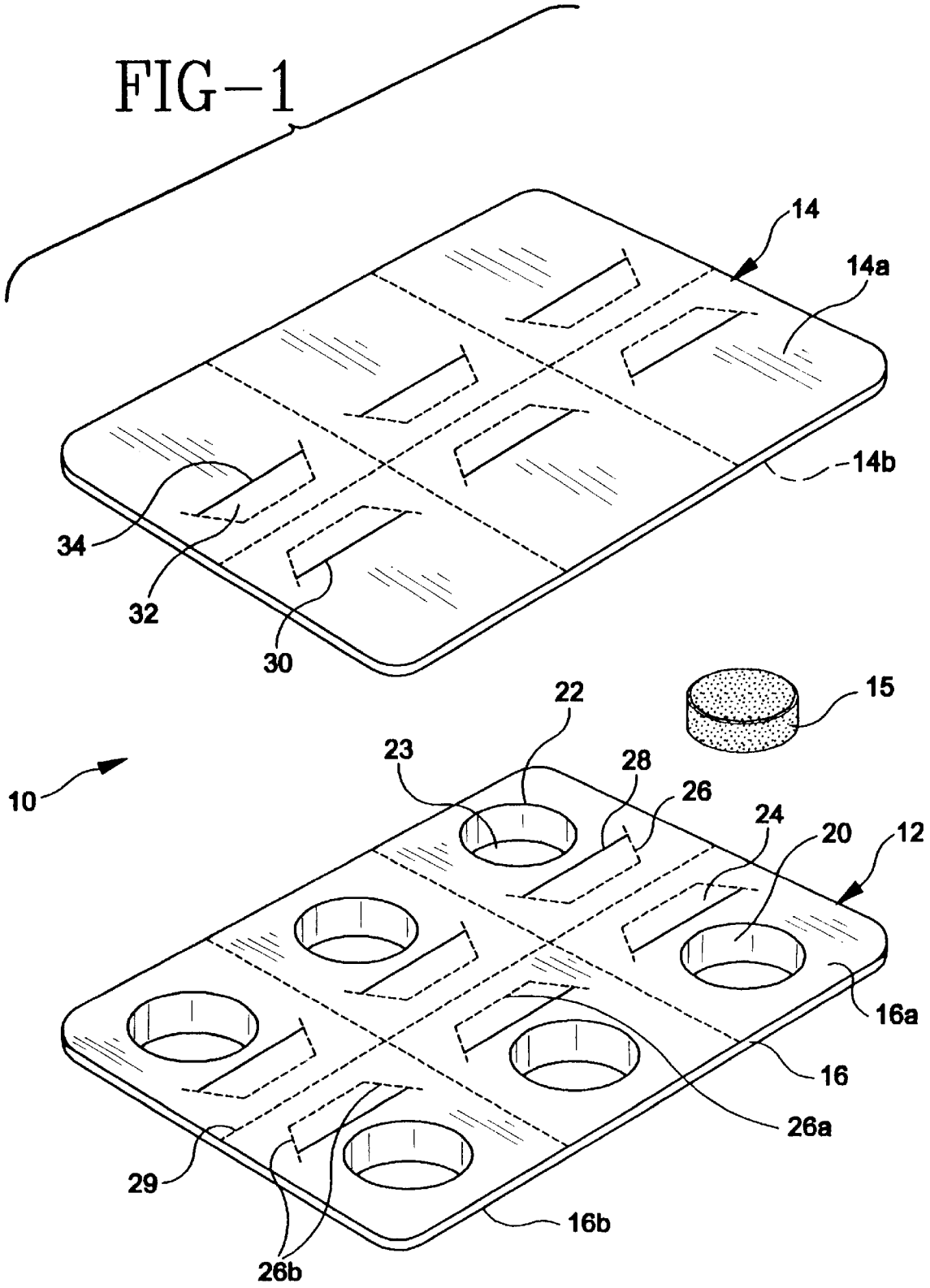
FIG. 1 is an exploded bottom perspective view of one embodiment of the tablet package assembly of the present invention showing a lid stock disposed over a blister tray for accommodating tablets.

The present invention provides a novel package for accommodating and dispensing tablets such as pharmaceutical tablets. The package of the present invention provides a child-resistant package in that the construction of the package makes it difficult for the typical child to apply the force necessary to remove the tablet from the package and/or requires significant manual dexterity to remove the tablet from the package which would not ordinarily be within the range of the typical child.

The present invention also provides a child-resistant package for low density tablets, that is, tablets having a porous low density structure rendering the tablet relatively fragile. An example of a low density tablet which may be contained in the package of the present invention is shown in described in commonly assigned U.S. Pat. No. 5,622,719, issued Apr. 22, 1997 which is incorporated by reference herein for all purposes.

Referring now to the drawings, a package assembly for accommodating and dispensing pharmaceutical tablets in accordance with the present invention may now be described.

Figure 2:
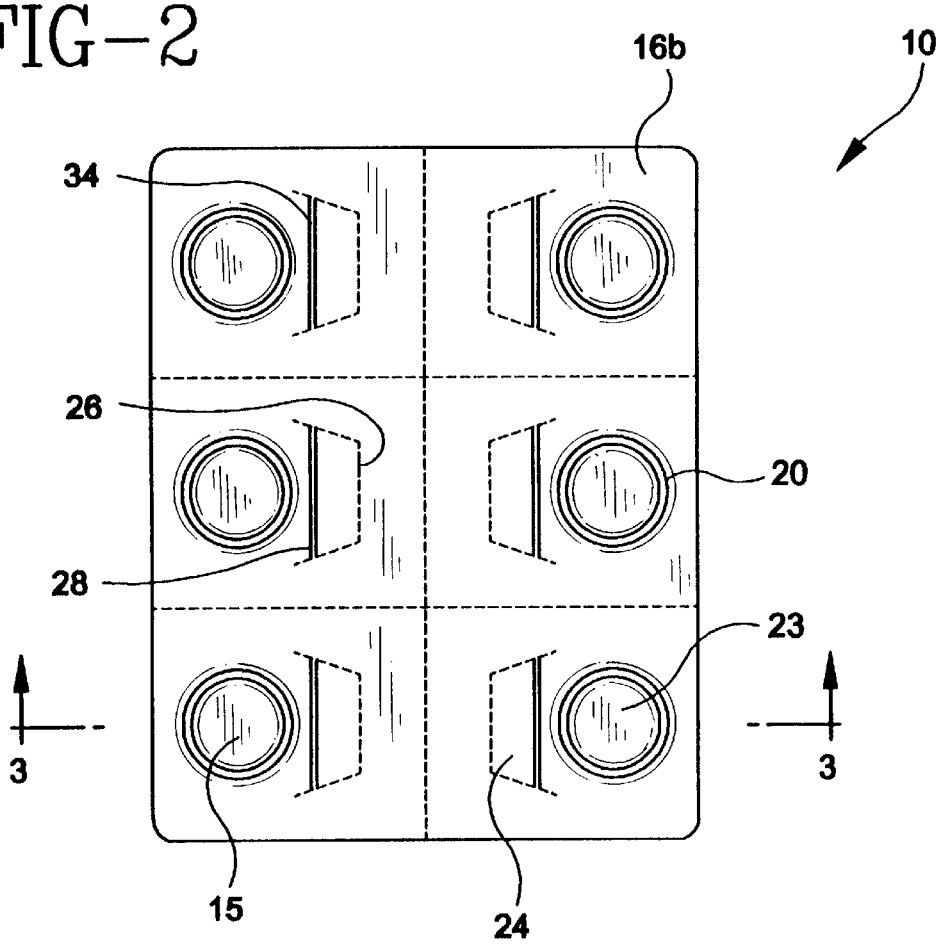
FIG. 2 is a top plan view of the tablet package assembly of FIG. 1.
Figure 3:
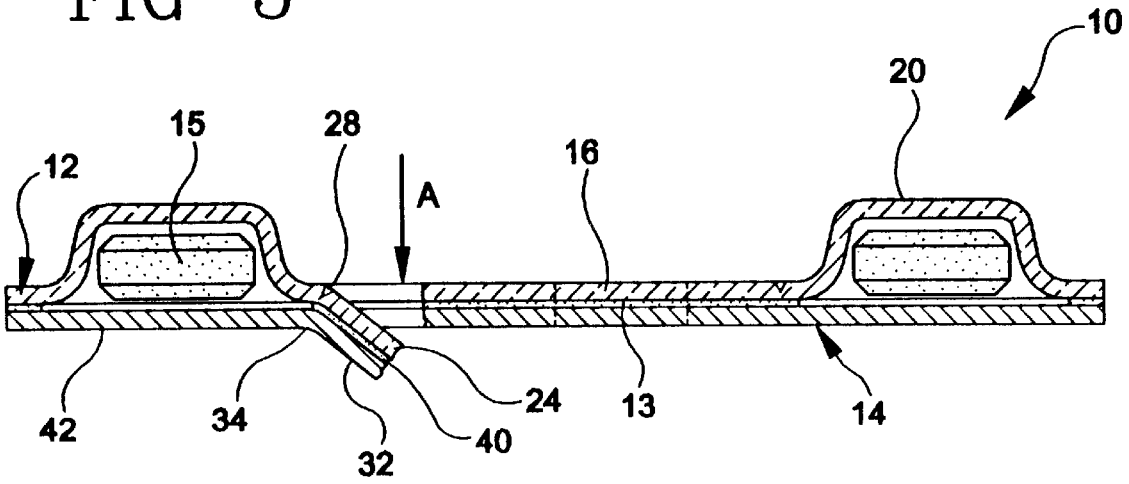
FIG. 3 is a cross-sectional view of the package assembly of FIG. 2 taken through the lines 3—3 thereof.

Referring specifically to FIGS. 1–3, one embodiment of the package assembly of the present invention is shown. The tablet package assembly 10 includes a blister tray 12 and a lid stock 14 which may be positioned over blister tray 12 to accommodate tablets 15 therebetween.

Blister tray 12 is generally a thermo-formed plastic member typically formed of water vapor impermeable or resistant plastic such as polyvinyl chloride ("PVC"), polypropylene ("PP"), custom laminated materials, etc. Further, blister tray 12 may be transparent so as to allow viewing of tablets 15 contained therein. Blister tray 12 includes a generally planar portion 16 having a first planar surface 16*a* and opposed second planar surface 16*b*. A plurality of blister depressions 20 are formed in planar portion 16. Each blister depression 20 includes an open end 21 opening towards first surface 16*a* of planar portion 16 and a closed lower end 23 which extends below the second surface 16*b* of planar portion 16. The blister depressions 20 are formed to have the general size and configuration of tablet 15 which is contained therein. The blister depressions 20 may be arranged in any number or array desirable. However, as is common with respect to pharmaceutical tablet packaging, the blister depressions are typically arranged in aligned rows and columns. The aligned rows and columns of blister depressions are further defined and separated by package perforations 29 which divide the blister depressions 20 into individual tablet containing units. This allows an individual packaged tablet to be removed from the remainder of the package assembly 10.

Blister tray 12 further includes a plurality of tray tab portions 24, one tray tab portion 24 being associated with and spaced adjacent to each blister depression 20. Each tray tab portion 24 is defined by a partially parametrically bounding blister perforation 26 together with a die cut slit 28. As shown herein, each perforation 26 includes a longitudinal side 26*a* and a pair of angularly disposed lateral sides 26*b* which in combination with die cut slit 28 define a generally trapezoidal shaped tray tab portion 24. Such a configuration is provided for efficiency of manufacture, however the tray tab portion 24 may assume other shapes, such as semi-circular. Die cut slit 28 extends through planar portion 16 from first surface 16*a* to second surface 16*b*. As will be described in further detail hereinbelow, die cut slit 28 and the perforations 26 allow tray tab portion 24 to be manually displaced from the planar portion 16 of blister tray 12. Preferably slit 28 should be at least as wide as, and more preferably wider than, the blister depression 20.

Tablet package assembly 10 of the present invention further includes lid 14 provided for sealed overlying disposition with respect to blister tray 12. Lid 14 is a generally thin flexible planar member having opposed surfaces 14*a* and 14*b*, with surface 14*b* being positioned for sealed engagement with first surface 16*a* of blister tray 12. Lid 14 may be formed of a vapor barrier material such as aluminum foil, plastic sheet or a custom laminated combination thereof appropriate to seal the formed depression. In the present illustrative embodiment, lid 14 is formed of a paper/foil laminate where a paper sheet defines surface 14*a* and a foil sheet defines surface 14*b*. The composite paper/foil laminate is water vapor impermeable.

Figure 7:
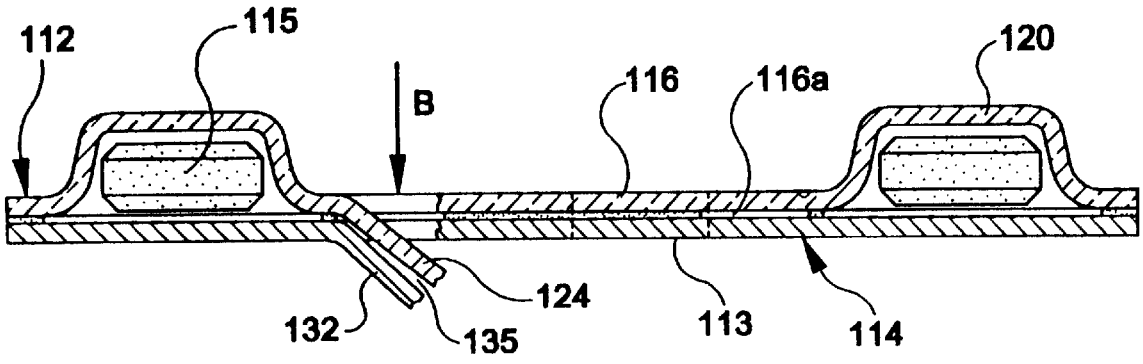
FIG. 7 is a cross-sectional view of the package assembly of FIG. 6 taken through the lines 7—7 thereof.
Figure 8:
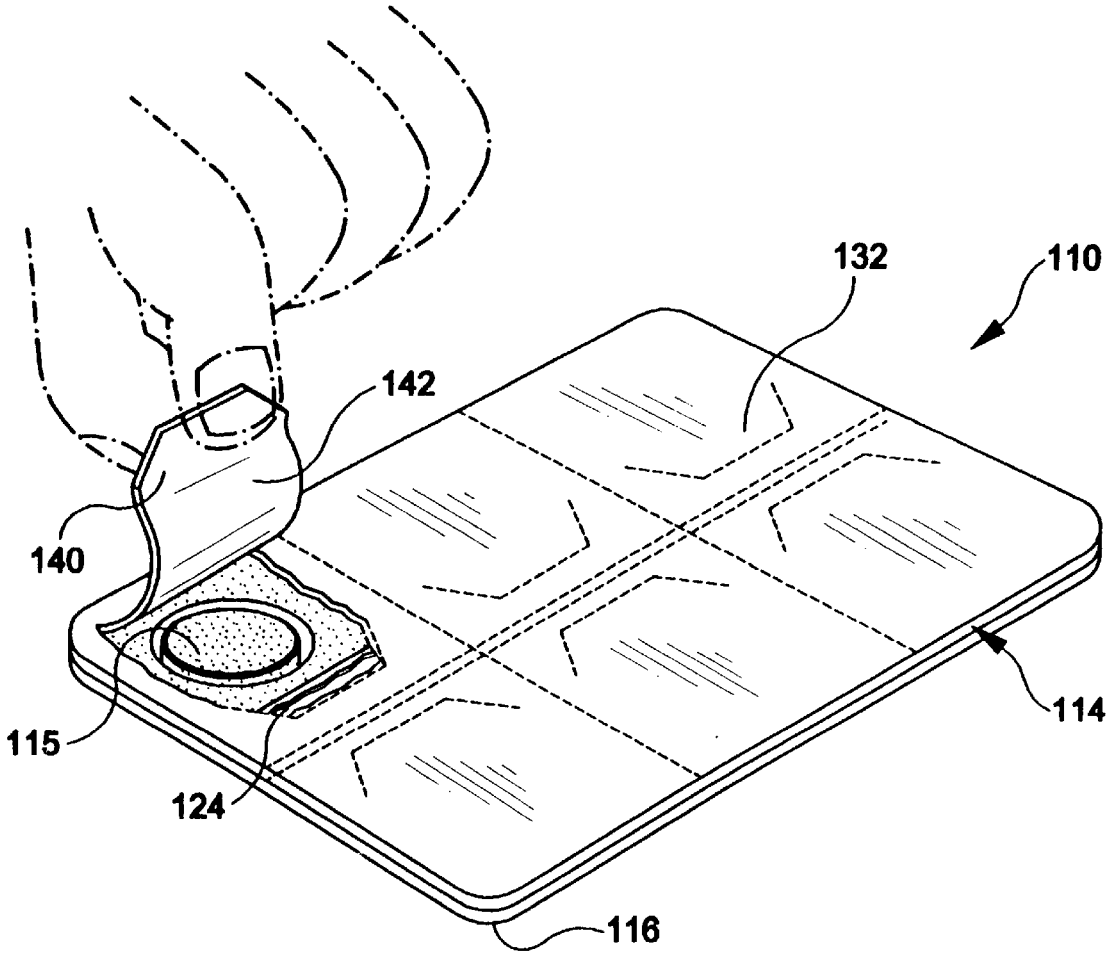
FIG. 8 is a bottom perspective view of the assembled tablet package of FIG. 5 with a portion thereof peeled away exposing the tablet for dispensing.

Surface 14*b* of lid 14 is typically adhered to first surface 16*a* of planar portion 16 of blister tray 12 by use of a removable non-aggressive adhesive 13 (FIG. 7). Such adhesive may be typically applied to the first surface 16*a* of planar portion 16 of blister tray 12. The adhesive is of the type which will permit the peelable removal of the lid 14 therefrom. These adhesives are generally custom or proprietary formulations provided by adhesive manufacturers and appropriate to seal the blister tray depending upon materials utilized in the package.

Lid 14 includes a plurality of cover perforations 30 extending therethrough. Cover perforations 30 are generally of a size and shape which closely approximate the size and shape of blister perforations 26 of blister tray 12. Cover perforations 30 are designed to be generally aligned with and overlie blister perforations 26 when cover 14 is adhesively secured to tray 12. Cover perforations 30 define partially bounded cover tab portions 32 which overlie and are adhered to tray tab portions 24 of blister tray 12. The size of the perforations and the land area between the perforations (not labeled) are derived by trial and error according to the degree of difficulty in opening desired and the type of materials used to form the lid stock 14 and blister tray 12. Lid 14 may also include a fold line 34 therein which is generally aligned with die cut slot 28 so as to facilitate deflectable separation of cover tab portions 32 from lid 14 in a manner which will be described more fully hereinbelow.

In conventional fashion well known in the tablet package art, tablet package assembly 10 of the present invention is assembled by inserting pharmaceutical tablets 15 within blister depressions 20 of blister tray 12. Lid 14 is then adhesively secured to blister tray 12 to fully environmentally seal tablets 15 within package 10.

Figure 4:
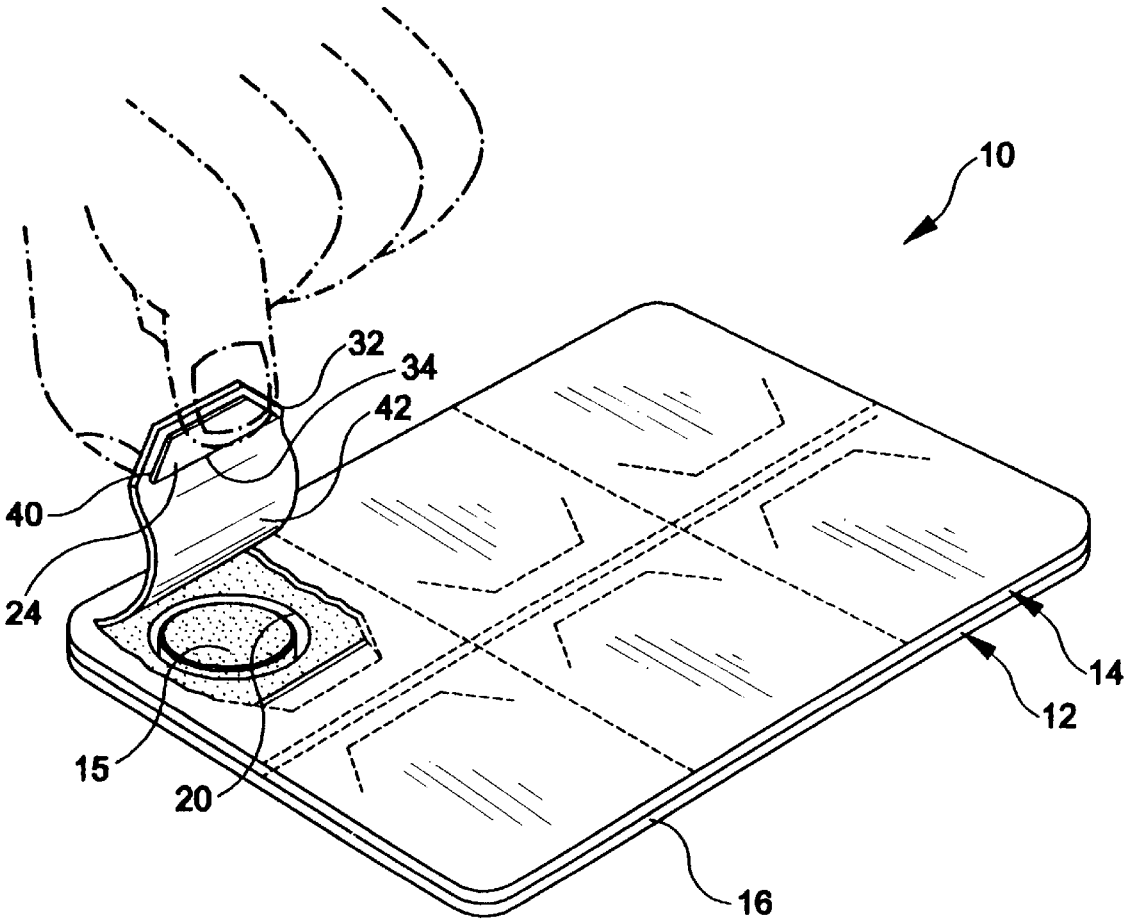
FIG. 4 is a bottom perspective showing of the assembled tablet package of FIG. 1 with a portion thereof peeled away exposing the tablet for dispensing.
Figure 5:
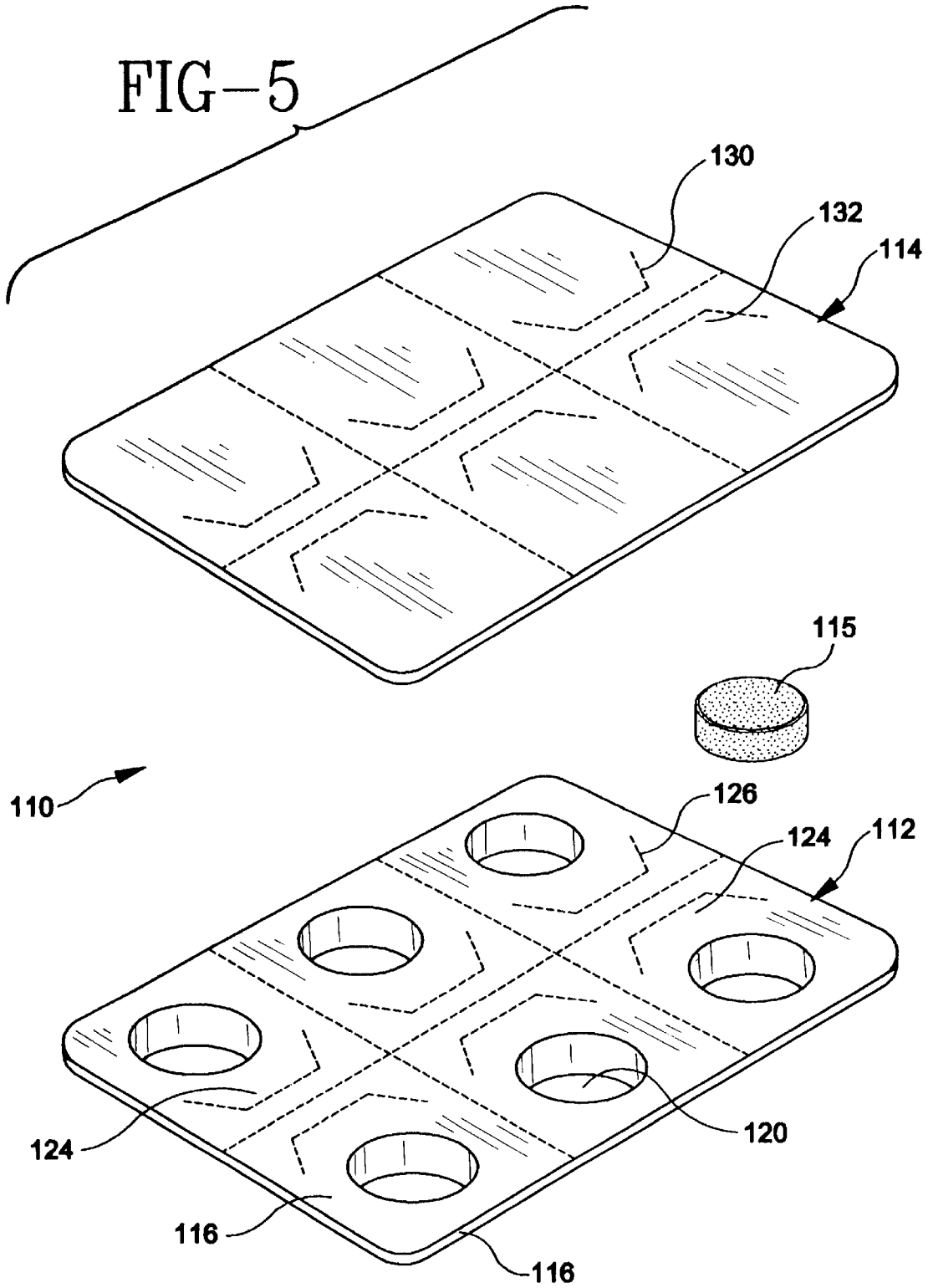
FIG. 5 is a bottom perspective view of a further embodiment of the present invention showing a lid stock disposed over a blister tray for accommodating tablets.

The dispensing of an individual tablet 15 from tablet package assembly 10 may be described with respect to FIGS. 2–4. In order to dispense an individual tablet 15 from tablet package assembly 10, aligned tray tab portion 24 and cover tab portion 32 may be manually frangibly depressed through the planar portion 16 of tray 12 and cover 14 in the direction of arrow A (FIG. 3). Such manual depression may be effected by finger pressure exerted by the user. The puncturable depression of tray tab portion 24 through planar portion 16 is facilitated by perforation 26 and die cut slit 28. Upon such manual depression, tray tab portion 24 will be completely severed from planar portion 16 of blister tray 12 as the perforated securement of tray tab portion 24 is overcome by such manual depression. The die cut slit 28 facilitates such complete frangible removal of tray tab portion 24 from planar portion 16. However, upon such removal thereof, tray tab portion 24 will remain adhesively engaged to cover tab portion 32 which has been punctured through the plane of lid 14 yet retained on cover 14 at fold line 34. The puncturing of cover tab portion 32 is facilitated by cover perforation 30.

As shown in FIG. 4, the combination of tray tab portion 24 and cover tab portion 32 establishes a manually graspable peel tab 40. Peel tab 40 may be manually grasped from the under side (cover side) of tablet package assembly 10 by the user so as to facilitate peelable removal of a portion 42 of lid 14 directly overlying blister depression 20. Upon removal of overlying portion 42 of lid 14, tablet 15 will be exposed permitting easy removal of tablet 15 from blister depression 20.

As shown in FIG. 3, the manual force necessary to puncture tray tab portion 24 through planar portion 16 of blister tray 12 is applied at a location which is spaced from blister depression 20 containing tablet 15. Thus, the manual puncture force is not applied directly to or over fragile tablet 15. This prevents destruction of the fragile tablet during the removal process. Furthermore, the requisite steps necessary to effectively remove the portion 42 of lid 14 from blister tray 12 so as to expose tablet 15 is such that it is not readily accomplishable by a typical child.

A further embodiment of the child-resistant tablet package assembly of the present assembly is shown with respect to FIGS. 5–8. The embodiment of FIGS. 5–8 is substantially similar to the tablet package assembly of FIGS. 1–4. For convenience of description, 100 has been added to the reference numerals of similar components of the embodiment of FIGS. 1–4.

Tablet package assembly 110 includes a blister tray 112 and a lid 114 which may be positioned over blister tray 112 so as to accommodate tablets 115 therebetween. Blister tray 112 is substantially similar to blister tray 12 described above with respect to FIG. 1. Perforations 126 define tray tab portions 124 adjacent each blister depression 120. In the present embodiment, tray tab portions 124 are defined solely by blister perforations 126 with the die cut slit 28 of tray 12 (FIG. 1) being absent herein.

Lid 114 is substantially similar to lid 14 of FIG. 1 and includes cover perforations 130 of size and shape similar to blister perforations 126. Cover perforations 130 are also designed to be generally aligned with and overlie blister perforations 126 when cover 114 is adhesively secured to tray 112 by adhesive 113.

Figure 6:
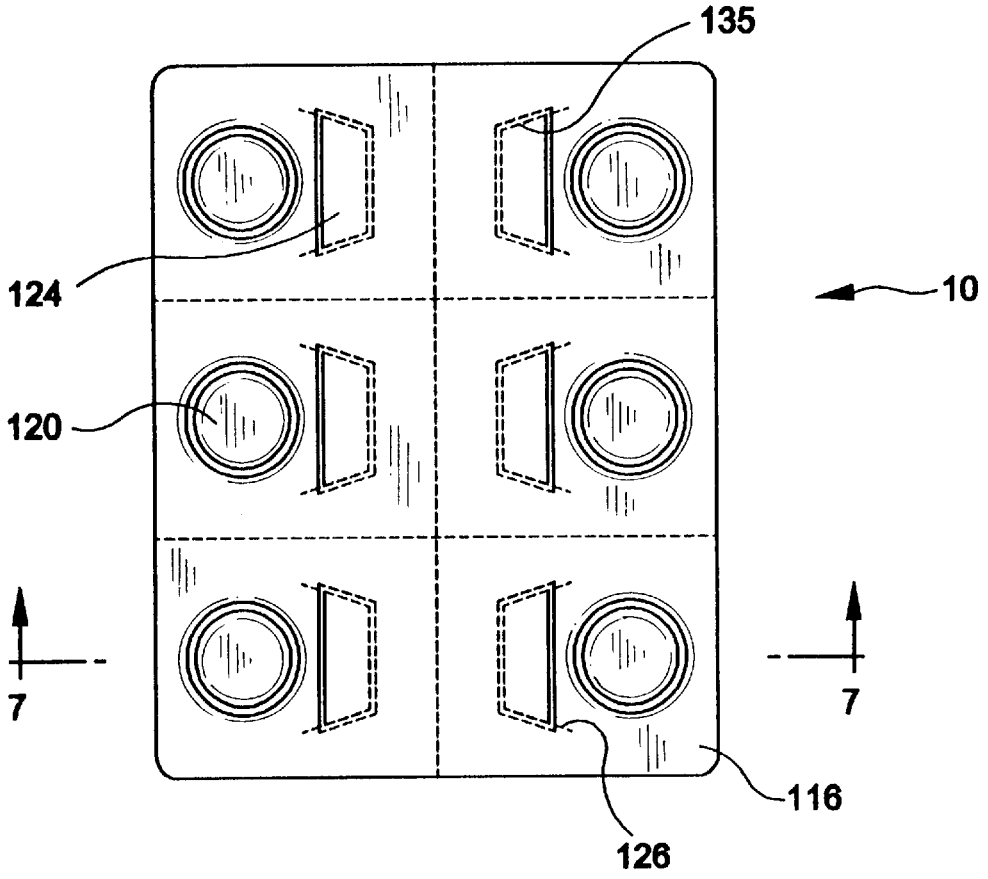
FIG. 6 is a top plan view of the tablet package assembly of FIG. 5.

In the present illustrative embodiment and as particularly shown in FIGS. 6 and 7, the adhesive securement of lid 114 to blister tray 112 is achieved without adhesive bonding of cover tab portion 132 to tray tab portion 124. It is contemplated that such non-adhesive securement between cover tab portions 32 and tray tab portion 124 is achieved by excluding adhesive from region 135 of tray tab portions 124 when the adhesive 113 is applied to the first surface 116*a* of blister tray 112. Thus, a non-adhesive region 135 is established between each cover tab portion 132 and tray tab portion 124.

The dispensing of an individual tablet 115 from tablet package assembly 110 is accomplished in a manner substantially similar to that described above with respect to tablet package 10. In order to dispense an individual tablet 115 from tablet package assembly 110, aligned tray tab portion 124 is depressed through the planar portion 116 of tray 112 in the direction of arrow B (FIG. 7). The tray perforations 126 facilitate the puncturable displacement of tray tab portion 124 from planar portion 116. Such frangible puncturable displacement of each tray tab portion 124 from planar portion 116 also causes cover tab portion 132 to be frangibly displaced from planar cover 114. The cover perforations 130 facilitate such puncturable frangible displacement.

In the present illustrative embodiment as there is no adhesive securement of tray tab portion 124 to cover tab portion 132 and as tray tab portion 124 remains attached to planar portion 116 of tray 112 by the absence of die cut slit 28 (FIG. 1), peel tab 140 is established on the underside (cover side) of tablet package 110 by cover tab portion 132 alone. The non-adhered cover tab portion may be manually grasped by the user so that portion 142 of lid 114 may be peelably removed from its overlying position over blister depression 120. Upon removal of portion 142 of lid 114, tablet 115 will be exposed permitting the easy removal of tablet 115 from blister depression 120.

The present embodiment shown with respect to FIGS. 5–8 provides for easy and economical manufacture of the tablet package assembly in that the separate die cut slit in the blister tray, which must be typically formed in a secondary operation, is not required to establish a peel tab.

Various changes to the foregoing described and shown structures would now be evident to those skilled in the art. Accordingly, the particularly disclosed scope of the invention is set forth in the following claims.

What is claimed is:

1. An entry-resistant tablet package comprising:

a blister tray having a first planar surface including a plurality of spaced-apart, open-ended tablet accommodating blister depressions formed therein, said tablet accommodating blister depressions opening onto said first surface, said blister tray further including a frangible tray extent adjacent each blister depression, wherein each said frangible tray extent is spaced apart from others of said frangible tray extents and comprises partially parametrically bounding blister perforations, each said frangible tray extent being manually puncturable through said planar surface, wherein said perforations of each said extent do not intersect with the perforations of any other tray extent; and a planar blister cover removably sealed over said first surface of said blister tray and having portions overlyingly disposed over said open ends of said tablet accommodating blister depressions, said blister cover further including spaced apart frangible cover extents overlying each spaced apart tray extent, wherein each said cover extent is bounded partially parametrically by perforations and is frangibly displaceable from the plane of said blister cover upon said manual puncturing of said tray extent so as to establish a graspable peel tab, wherein the perforations which partially bound the margins of said cover extents overlie said tray extents to facilitate peelable removal of said portions of said cover from said overlying disposition with respect to said tablet accommodating blister depressions to expose said tablets for dispensing.

2. A tablet package of claim 1 wherein said cover is formed of a multi-component laminate structure.

3. A table package of claim 2 wherein said tray is formed of a thermo-formed molded plastic.

4. A tablet package of claim 3 wherein said tray extents and said cover extents are mutually manually puncturable.

5. A tablet package of claim 4 wherein said tray extents and said cover extents are displaced in a direction from said blister tray toward said blister cover.

6. A tablet package of claim 5 wherein said tray extents are frangibly formed with said tray.

7. A tablet package of claim 6 wherein said tray extents are in overlying adhesive engagement with said cover extents and wherein each said peel tab includes said tray extent and said cover extent.

8. A tablet package of claim 6 wherein said tray extents are in non-adhesive overlying disposition with respect to said cover extents.

9. A tablet package of claim 5 wherein cover extents are further defined by a cover perforations.

10. A tablet package of claim 9 wherein said tray extents are defined by tray perforations generally aligned with said cover perforations.

11. A tablet package of claim 9 wherein said frangible tray extents are further defined by an elongate slit, said slit extending through said planar first surface at a location adjacent said cover perforation.

12. A child resistant package for containing and dispensing tablets comprising: a blister tray having plural blister depressions formed therein for accommodating said tablets; and a cover disposing over said blister tray for enclosing said tablets within said blister depressions;

said cover and said tray having aligned frangible portions spaced from said blister depressions, said frangible portions being spaced apart from one another in said cover and said tray and each said frangible portion being defined by a partially parametrically bounding perforation, each said portion being puncturably displaceable to define a peel tab for peelable removal of a portion of said cover overlying said blister depression, wherein said perforation does not intersect with the perforations of any other said frangible portion.

13. A child resistant package of claim 12 wherein said aligned frangible portions of said cover and said tray are formed by respective aligned perforations in said cover and said tray.

14. A child resistant package of claim 13 wherein said tray includes a die cut slit, which in combination with said tray perforations permits puncture removal of said tray portion from said tray.

15. A child resistant package of claim 14 wherein said cover is adhesively secured to said blister tray with said aligned frangible portions of said cover and tray being adhesively attached.

16. A child resistant package of claim 15 wherein each said peel tab includes said cover portions and said adhesively attached tray portions.

17. A child resistant package of claim 13 wherein said cover is adhesively secured to said blister tray with said aligned frangible portions of said cover and said tray being in non-adhesive overlying disposition.

18. A child resistant package of claim 17 wherein each said peel tab is defined by said cover portion.

19. An entry-resistant tablet package comprising:

a blister tray having a first planar surface including a plurality of spaced-apart, open-ended tablet accommodating blister depressions formed therein, said tablet accommodating blister depressions opening onto said first surface, said blister tray further including a frangible tray extent adjacent each blister depression, wherein each said frangible tray extent is spaced apart from others of said frangible tray extents and comprises partially parametrically bounding blister perforations, each said frangible tray extent being manually puncturable through said planar surface, wherein said perforations of each said extent do not intersect with the perforations of any other tray extent; and a planar blister cover removably sealed over said first surface of said blister tray and having portions overlyingly disposed over said open ends of said tablet accommodating blister depressions, said blister cover further including spaced apart frangible cover extents overlying each spaced apart tray extent, wherein each said cover extent is bounded partially parametrically by perforations and is non-removably sealed to its corresponding tray extent and is frangibly displaceable from the plane of said blister cover upon said manual puncturing of said tray extent so as to establish a graspable peel tab, wherein the perforations which partially bound the margins of said cover extents overlie said tray extents to facilitate peelable removal of said portions of said cover from said overlying disposition with respect to said tablet accommodating blister depressions to expose said tablets for dispensing.

* * * * *